US007760153B2

(12) United States Patent
Bulow

(10) Patent No.: US 7,760,153 B2
(45) Date of Patent: Jul. 20, 2010

(54) LINEAR MOTOR POWERED LIFT ACTUATOR

(75) Inventor: Jeffrey A. Bulow, Syracuse, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 155 days.

(21) Appl. No.: 12/138,899

(22) Filed: Jun. 13, 2008

(65) Prior Publication Data

US 2009/0309800 A1 Dec. 17, 2009

(51) Int. Cl.
*H01Q 3/00* (2006.01)
*H01Q 3/02* (2006.01)

(52) U.S. Cl. ..... 343/765; 343/757; 343/766; 343/882

(58) Field of Classification Search ..... 343/757, 343/765, 766, 878, 880, 881, 882
See application file for complete search history.

(56) References Cited

U.S. PATENT DOCUMENTS

| | | | | |
|---|---|---|---|---|
| 3,889,551 | A | 6/1975 | Harmening | |
| 3,982,250 | A | 9/1976 | Giannatto et al. | |
| 4,143,378 | A | 3/1979 | Darrouzet | |
| 4,185,288 | A | 1/1980 | Dosch et al. | |
| 4,459,972 | A | 7/1984 | Moore | |
| 4,479,130 | A | 10/1984 | Snyder | |
| 4,656,484 | A | 4/1987 | Brown et al. | |
| 4,814,784 | A | 3/1989 | Pallmeyer | |
| 5,075,682 | A | 12/1991 | Dehnert | |
| 5,124,715 | A | 6/1992 | Homer | |
| 6,204,823 | B1 * | 3/2001 | Spano et al. | 343/766 |
| 6,603,422 | B2 | 8/2003 | Wright | |
| 6,677,890 | B2 | 1/2004 | Halsey et al. | |
| 7,000,357 | B1 | 2/2006 | Stearns et al. | |
| 7,133,001 | B2 | 11/2006 | Mrstik et al. | |
| 7,230,581 | B2 * | 6/2007 | McEwan | 343/882 |
| 7,256,748 | B2 | 8/2007 | Tietjen | |
| 7,385,562 | B2 * | 6/2008 | Stoyanov et al. | 343/765 |
| 2007/0205338 | A1 | 9/2007 | Sabatino | |

OTHER PUBLICATIONS

International Search report dated Aug. 19, 2009 for related PCT application No. PCT/US2009047227.

* cited by examiner

*Primary Examiner*—Hoang V Nguyen
(74) *Attorney, Agent, or Firm*—Howard IP Law Group, PC

(57) ABSTRACT

A lift actuator for supporting a radar antenna array and for selectively moving the antenna array between a retracted position and an erected operational position, said actuator includes a first linear induction driver movable along a first member and a second linear induction driver movable along a second member. The first and second members each have a distal and a proximal ends. The second member is pivotably connected at said proximal end to the first driver. A third rigid member is connected to the second driver. The third member has a distal end adapted to pivotably connect to a radar antenna array. The radar antenna array is constrained in the direction of the first member.

17 Claims, 7 Drawing Sheets

LINEAR MOTOR POWERED LIFT ACTUATOR

FIELD OF THE INVENTION

The present invention relates generally to an apparatus and a system for supporting and positioning an object, for example, a radar array antenna, and in particular to a linear motor powered lift actuator for a radar array antenna.

BACKGROUND OF THE INVENTION

Radar antenna systems frequently require rapid deployment in battlefields and other locations, often under severe time and manpower constraints. In particular battlefield radar antennas need to be highly mobile and rapidly deployable, often in less than ideal conditions. Furthermore, once an antenna system is deployed, it is often necessary to change the orientation and position of the antenna. Actuator systems such as hydraulic actuators and mechanical actuators have been used to raise and lower radar array antennas. However, such systems including, for example, pinion gear drive and worm gear drive based systems are slow, have relatively long response times and are subject to significant wear during operation. These components represent potential failure items in the system. Additionally, such mechanical designs have poor contingency overrides and tend to be heavy. Moreover, hydraulic systems have proven unreliable and prone to design shortfalls, resulting in significant costs and damage to the radar system. Other alternatives such as electro-mechanical options also are less responsive and slower than desired. Such systems also lack fast back-up or redundant recovery systems in case of a failure of the primary lift system. Hence, such solutions have proved to be unsatisfactory. Alternative means which are accurate, safe and have rapid response times are desired.

SUMMARY OF THE INVENTION

In an embodiment of the invention, a lift actuator for supporting a radar array antenna and for selectively moving the antenna array between a retracted position and an erected operational position includes a first linear induction driver movable along a first member and a second linear induction driver movable along a second member. First and second members each have a distal end and a proximal end. The second member is pivotably connected at the proximal end to the first driver. A third rigid member is connected to the second driver and has a distal end adapted to pivotably connect to a radar array antenna. The radar array antenna is constrained in the direction of the first member. In one embodiment, movement of the radar antenna array is constrained to pivoting about an axis at a proximal end responsive to movement of the linear induction driver along the first member.

Another embodiment of the present invention includes a system for supporting a radar array antenna and for selectively moving the antenna between a retracted position and an erected operational position. The system includes a lift actuator having a first and a second linear induction driver movable along a first and a second member respectively. Each of the first and the second members has a proximal end and a distal end. The second member is pivotably connected at the proximal end to the first driver. A third rigid member is connected at the proximal end to the second driver and pivotably connected at its distal end to a distal end of the array antenna. The system further includes a pivoting member pivotably coupled to a proximal end of the array antenna so as to constrain the motion of the array along the direction of the first member.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts and in which.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in typical radar array antenna systems. However, because such elements are well known in the art, and because they do not facilitate a better understanding of the present invention, a discussion of such elements is not provided herein. The disclosure herein is directed to all such variations and modifications known to those skilled in the art.

Figure 1:
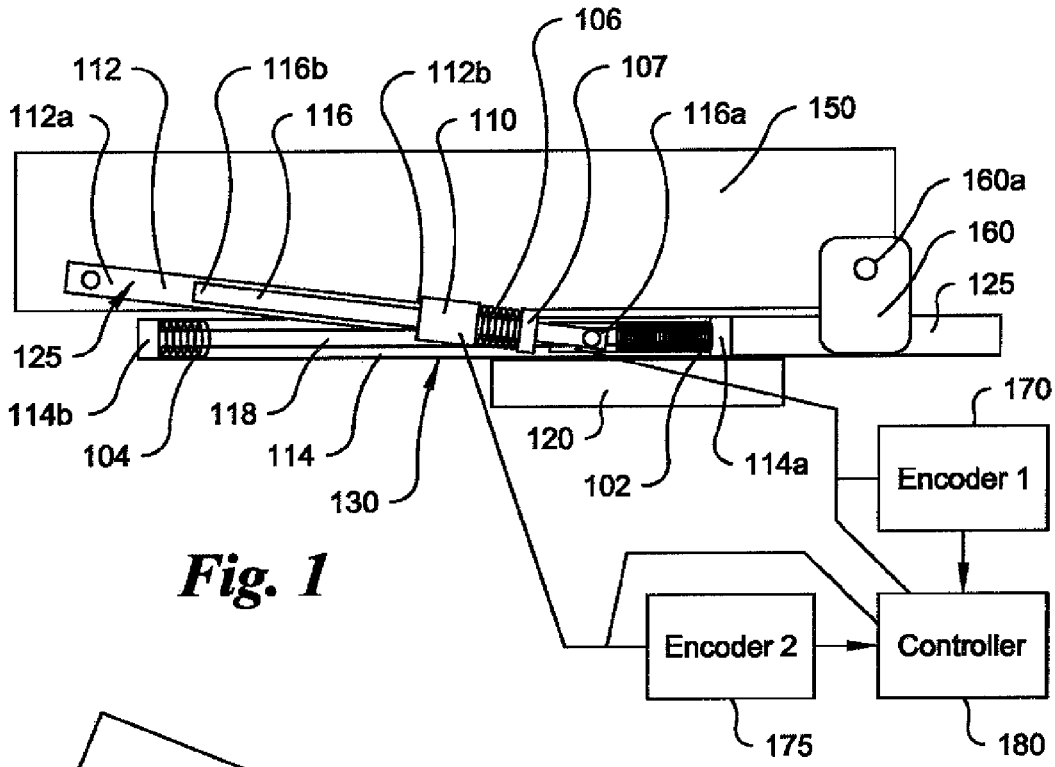
FIG. 1 illustrates an embodiment of a linear motor-powered lift actuator for a radar array antenna in a stowed position.
Figure 9:
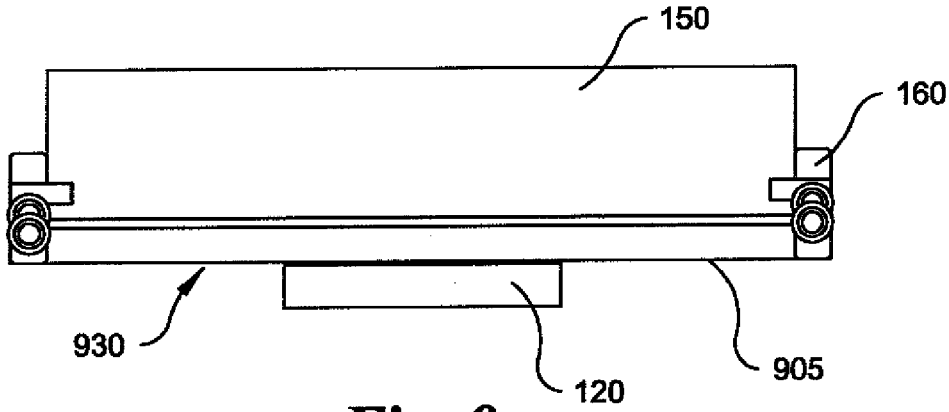
FIG. 9 illustrates an end view of the radar array antenna of FIG. 1 in a stowed position.
Figure 10:
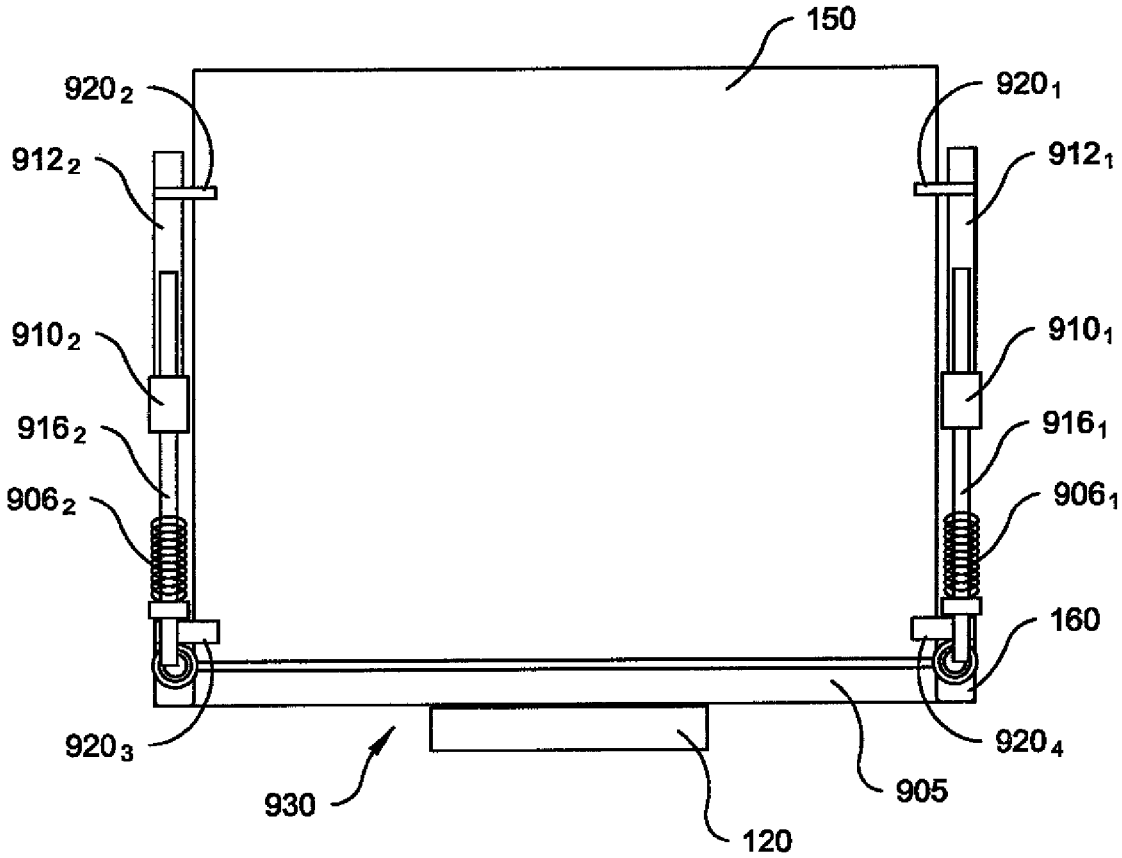
FIG. 10 illustrates an end view of the radar array antenna of FIG. 1 in a deployed position.

FIGS. 1, 9 and 10 show a radar array antenna 150 equipped with an exemplary embodiment of a dual balanced lift actuator mechanism 130. Lift actuator mechanism 130 is mounted on a rotatable platform 120. In one embodiment, a base 125 is mounted on rotatable platform 120 and adapted to carry lift actuator mechanism 130 and array antenna 150. In an exemplary embodiment, platform 120 is a rotatable platform. Such platforms are known in the art and further detail is omitted for the sake of brevity.

Actuator mechanism 130 includes a first member 118 and a second member 116, as seen in the side view illustrated in FIG. 1. A first linear induction driver 108 (best shown in FIG. 2) is movably coupled with first member 118. Driver 108 and first member 118 together form a first linear induction motor. A second linear induction driver 110 is movably coupled with second member 116. Driver 110 and second member 116 form a second linear induction motor. First member 118 and second member 116 may take the form of a flat magnetic track, for example. A magnetic track may, for example, be constructed by solidly affixing magnets on a structurally strong framework such as a steel track. Such construction is well known to those skilled in the art. Driver 108 and driver 110 may take the form of corresponding non-contact forcer coils. An exemplary coil may be constructed by encapsulating wires in epoxy. Drivers 108, 110 may be slotless iron or slotted iron type forcers, for example. In an exemplary configuration of a slotless iron forcer, wire coils are mounted to iron laminations and then to an aluminum base. In an exemplary configuration of a slotted iron forcer, wire coils are mounted into a steel structure with an iron core. It is, of course, understood that other similar materials may be used.

Figure 2:
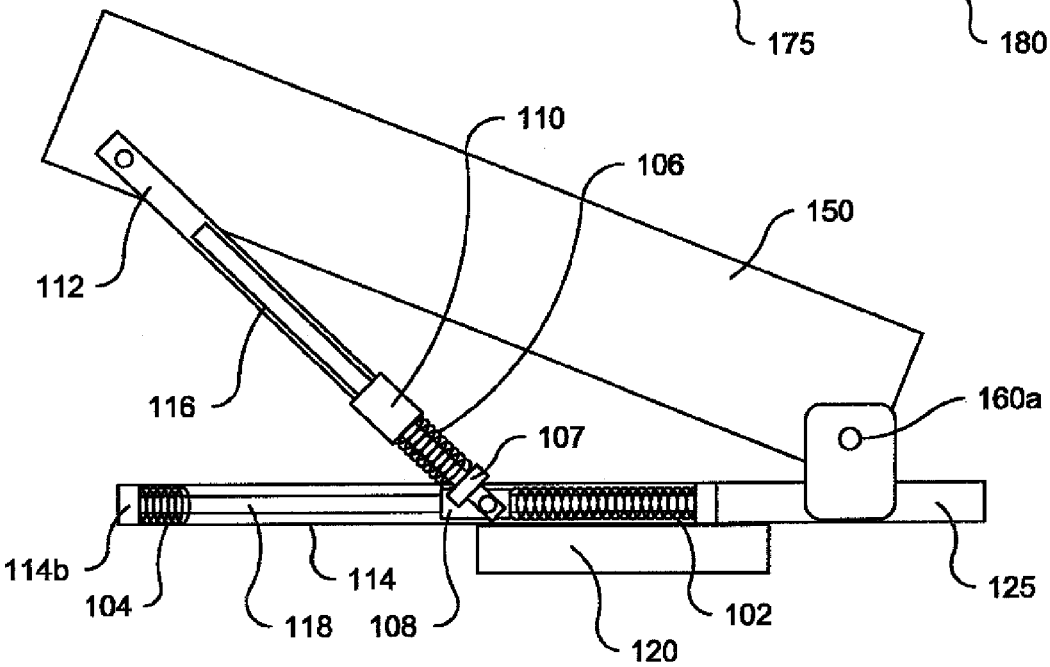
FIG. 2 illustrates the lift actuator of FIG. 1 wherein the pre-loaded spring elements provide initial lift to the radar array antenna.

Still referring to FIG. 1, first member 118 may be encapsulated in a hollow member 114 to prevent debris from the environment from entering the gap between first member 118 and first driver 108 (see FIG. 2). A spring element 102 is disposed between first driver 108 and an end 114*a* of hollow member 114. Another spring element 104 is disposed at an end 114*b* of hollow member 114. Spring element 102 is pre-loaded or compressed when the radar array antenna 150 is in a stowed position, as shown in FIG. 1.

Second member 116 is pivotably connected to first driver 108 (of FIG. 2). A spring element 106 is disposed between an end cap 107 on second member 116 and driver 110. Spring element 106 is pre-loaded or compressed when the radar array antenna 150 is in a stowed position. A third member 112 is connected at an end 112*b* to second driver 110. Third member 112 is at least partially hollow to accommodate second member 116. Third member 112 is a rigid member, which is sufficiently rigid to withstand deflecting forces when radar array antenna 150 is being erected or lowered or is in an erect operational position. Third member 112 is adapted to pivotably connect at an end 112*a* to radar array antenna 150. Antenna 150 is pivotably connected to a pivoting member 160. Pivoting member 160 constrains the motion of antenna 150 so as to cause the array to rotate about a rotation point 160*a* in response to translation of first driver 108 in the direction of first member 118.

In an exemplary embodiment, actuator mechanism 130 further includes a first encoder 170 associated with driver 108 and a second encoder 175 associated with driver 110 for detecting the position of drivers 108, 110 relative to first member 118 and second member 116 respectively. It is understood that power is supplied to drivers 108, 110 in conventional fashion, such as via electrical wires connected to drivers 108, 110. Encoders 170, 175 operate in conventional fashion to provide an indicator or feedback signal as to the relative position of corresponding drivers 108, 110. Actuator mechanism 130 also includes a controller 180 which controls the position and/or movement of drivers 108, 110. By way of example, controller 180 provides voltage and/or current controlling input to drivers 108, 110 to control their relative motion and ensure proper positioning of antenna array 150.

FIGS. 9 and 10 illustrate end views of the antenna 150, along with the dual balanced lift actuator mechanism 130, in a stowed position and a deployed position respectively. Lift actuator mechanism 130 is mounted on a frame 905. In the exemplary embodiment illustrated herein, mechanism 130 includes a set of two lift actuators, each actuator having corresponding functional components as depicted in FIGS. 1-8, and wherein, referring to FIG. 10, a first actuator includes a second member $\mathbf{916}_1$, a spring element $\mathbf{906}_1$, a second driver $\mathbf{910}_1$, and a third member $\mathbf{912}_1$ while a second actuator includes a second member $\mathbf{916}_2$, a spring element $\mathbf{906}_2$, a second driver, $\mathbf{910}_2$, and a third member $\mathbf{912}_2$. Each of the two lift actuators is positioned substantially on opposite ends of antenna frame 905 and operates in conjunction with controller mechanism as described herein to support, raise and lower array 150 in a stable and uniform manner. Antenna 150 is connected to third members $\mathbf{912}_1$, $\mathbf{912}_2$ via two pins $\mathbf{920}_1$, $\mathbf{920}_2$. Antenna 150 is connected to pivoting members 160 via two pins $\mathbf{920}_3$, $\mathbf{920}_4$.

Exemplary operational steps for lifting the antenna 150 from a stowed position shown in FIG. 1 to an erect operational position will be described with reference to FIGS. 2-5. Exemplary steps for lowering the antenna 150 from an erect operational position shown in FIG. 5 to a stowed position will be described with reference to FIGS. 6-8. As shown, pre-loaded spring elements 102, 106 provide an initial lift force to antenna 150. More particularly, in response to an activating event such as a directionally applied release voltage supplied to the linear induction drivers 108 (see FIGS. 1-2) or a manual means, and coupled with the release of a latch or other restraining mechanism, spring element 102 expands from its compressed state and pushes driver 108 causing driver 108 to move along first member 118 towards end 114*b*. In a similar fashion, spring element 106 pushes driver 110 causing driver 110 to move along second member 116. Since second member 116 is connected to driver 110, second member 116 would also move along with driver 110. However, second member 116 is rigidly connected to third rigid member 112, both members 112, 116 behave a single member 125. Since third member 112 is pivotably connected to radar antenna 150, single member 125 is also effectively pivotably connected to radar antenna 150. As single member 125 is pivotably connected to antenna 150, single member 125 is not free to move in the direction of first member 118 along with driver 110; rather, single member 125 pivots about driver 110 as well about antenna 150, thereby raising antenna 150.

Figure 3:
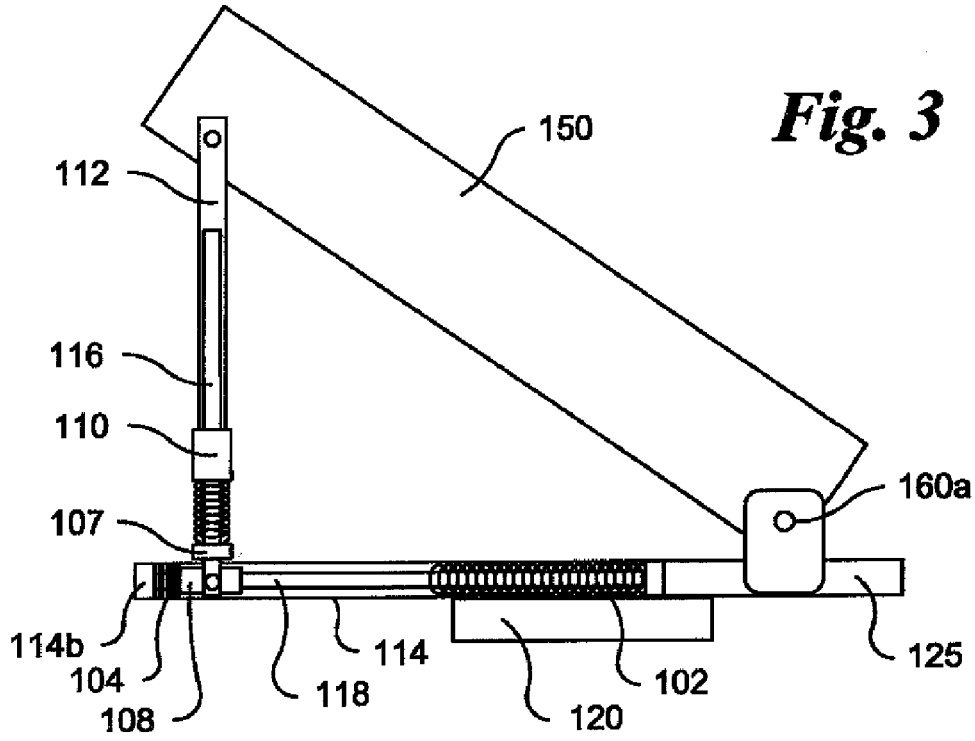
FIG. 3 illustrates the lift actuator of FIG. 1 wherein the first linear induction driver provides secondary lift to the radar array antenna.

Referring now to FIG. 3, in conjunction with FIG. 2, driver 108, in response to an actuating signal from the controller 180 (of FIG. 1), provides secondary lift force as it continues to move along first member 118 towards end 114*b*. When driver 108 reaches a pre-determined position with respect to first member 118, as detected by encoder 170 (of FIG. 1), encoder 170 (of FIG. 1) causes transmission of a signal to controller 180 (of FIG. 1). Responsive to the signal from encoder 170 (of FIG. 1), controller 180 causes supply of electric power to driver 108. Driver 108, energized by electric power, continues moving forward along first member 118. When driver 180 reaches near end 114*b* to another pre-determined position, encoder 170 (of FIG. 1) causes transmission of another signal to controller 180 (of FIG. 1). Controller 180 (of FIG. 1), responsive to signal from encoder 170 (of FIG. 1), reduces the supply of electric power to driver 108 causing driver 108 to slow down. Driver 108 then engages spring element 104. Spring element 104 gets compressed by driver 108 and by the increasing proportion of antenna array weight, thereby providing a braking force to driver 108. Once the array is positioned in its deployed position and secured therein, electric power may no longer be supplied to driver 108.

Figure 4:
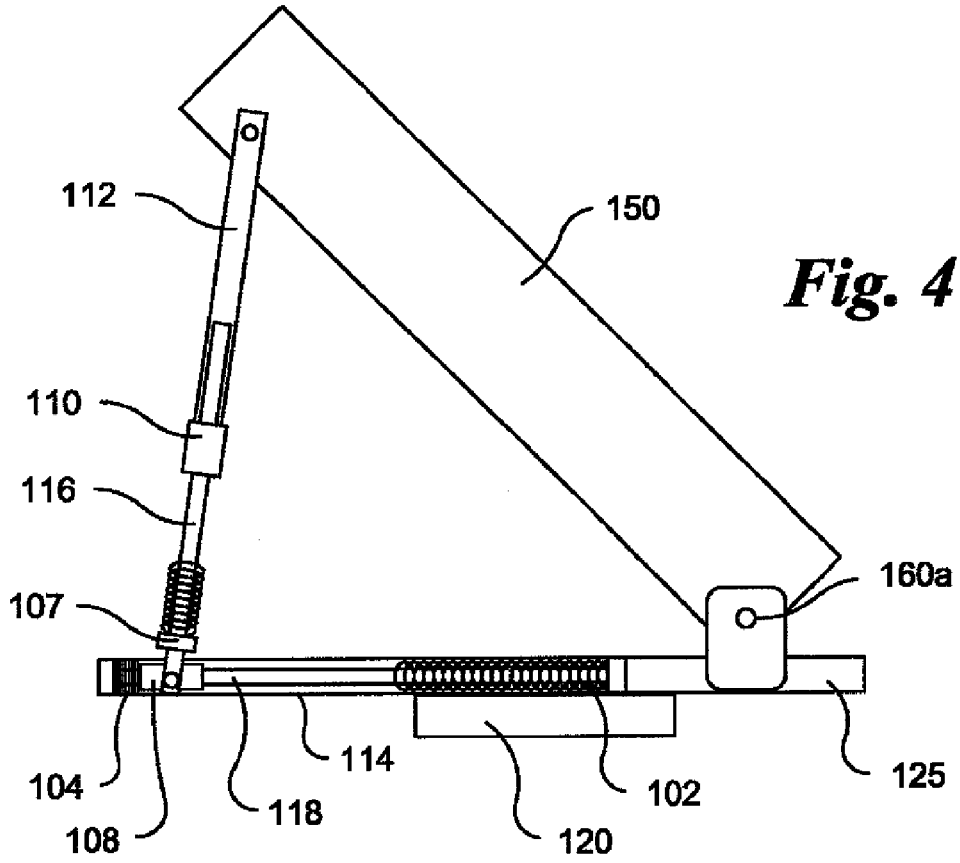
FIG. 4 illustrates the lift actuator of FIG. 1 wherein the second linear induction driver provides final lift to the radar array antenna.
Figure 5:
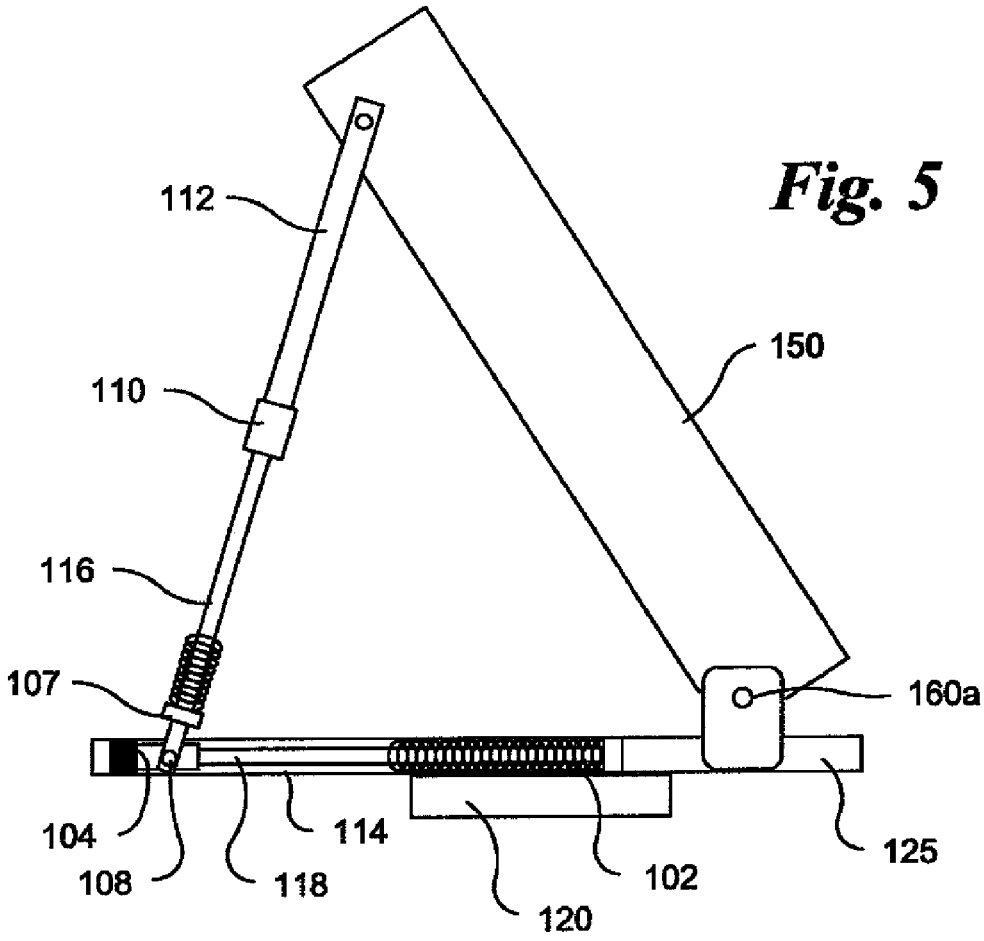
FIG. 5 illustrates the radar array antenna of FIG. 1 in a fully erect operational position.

Now referring to FIG. 4, driver 110, in response to an actuating signal from the controller 180 (of FIG. 1), provides secondary lift force to antenna 150 as driver 110 continues to move along second member 116 towards end 116*b*. When driver 110 reaches a pre-determined position with respect to second member 116, as detected by encoder 175 (of FIG. 1), encoder 175 (of FIG. 1) causes transmission of a signal to controller 180 (of FIG. 1). Controller 180 (of FIG. 1), responsive to signal from encoder 175 (of FIG. 1) causes electric power to be provided to driver 110, which then provides additional lift force as it starts moving along second member 116 away from end 116*a* until antenna 150 is positioned in an erect operational position shown in FIG. 5. Encoder 175 (of FIG. 1) upon detecting the position of driver 110 along second member 116, causes a transmission of signal to controller 180 (of FIG. 1) when driver 110 reaches another pre-determined position along second member 116. Controller 180 (of FIG. 1) reduces and/or interrupts the supply of electric power to driver 110, thereby stopping the movement of driver 110 along second member 116.

Upon reaching the operating position, a cam/spring actuated hook and post, or solenoid driven dead bolt and slot locking means can be implemented to prevent the driver (forcer) 110 from sliding back down support member 116. There are a variety of double state locking mechanisms that can be used for this purpose and which are known to one in the ordinary skill in the art and hence are not further detailed herein. A modified safety hook and slide mechanism such as that commonly used on extension ladders may be implemented to accomplish this function. The type of locking mechanism may be determined based on the application trades where the weight of the radar antenna, volume constraints, and materials selection may factor in this design. It is understood that the 'locked' or 'fixed' (with respect to the linear induction motor motion) position will be less than the maximum position at the full range of the linear induction motor motion to allow forcer 110 to be energized sufficiently to remove the weight and potential interference position to release the locking mechanism. The degree of range required to accomplish this is also application dependent and hence is not further discussed herein for brevity.

Figure 6:
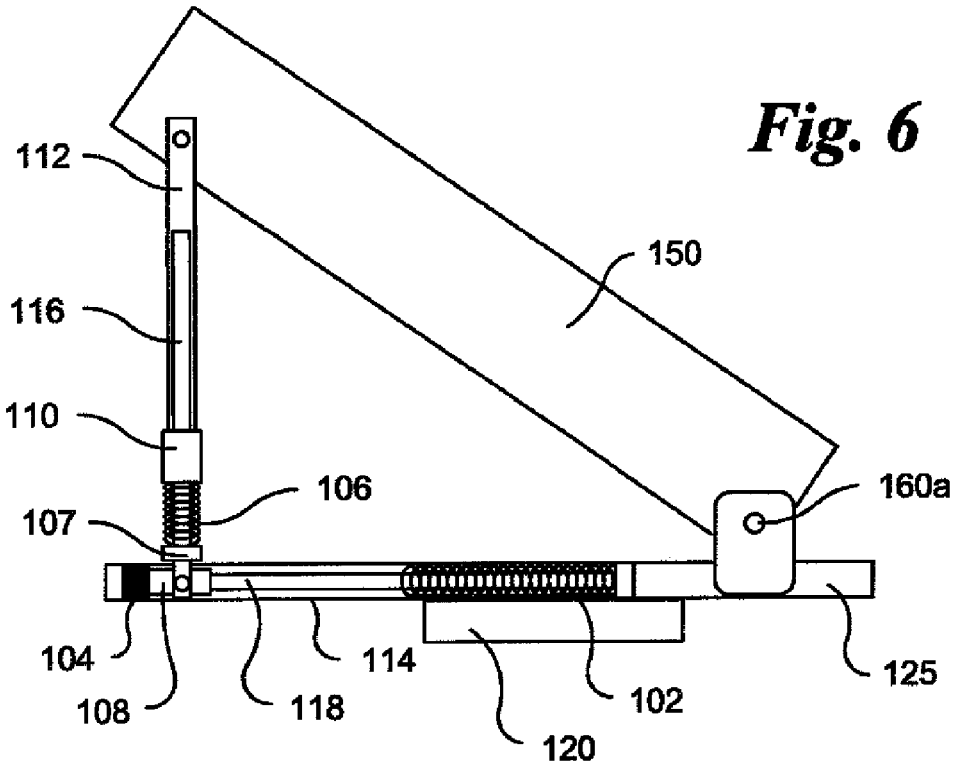
FIG. 6 illustrates the radar array antenna of FIG. 5 wherein the second linear induction driver provides the initial lowering force to the radar array antenna.

Operation of the antenna array system is further described with reference to FIG. 6, wherein controller 180 (of FIG. 1) causes the supply of electric power to driver 116. In response, driver 116 starts moving along second member 110 towards end 116*a*, thus lowering antenna 150. Encoder 175 (of FIG. 1) detects the position of driver 110 with respect to second member 110 and causes transmission of signal to controller 180 (of FIG. 1). Controller 180 (of FIG. 1), responsive to the signal from encoder 175 (of FIG. 1), reduces and/or interrupts the supply of electric power to driver 116 causing driver 116 to stop movement along second member 110 when driver 116 reaches the first pre-determined position. Spring element 106 provides a braking force when driver 116 approaches near end 116*a* along second member 110 and engages spring element 106.

Figure 7:
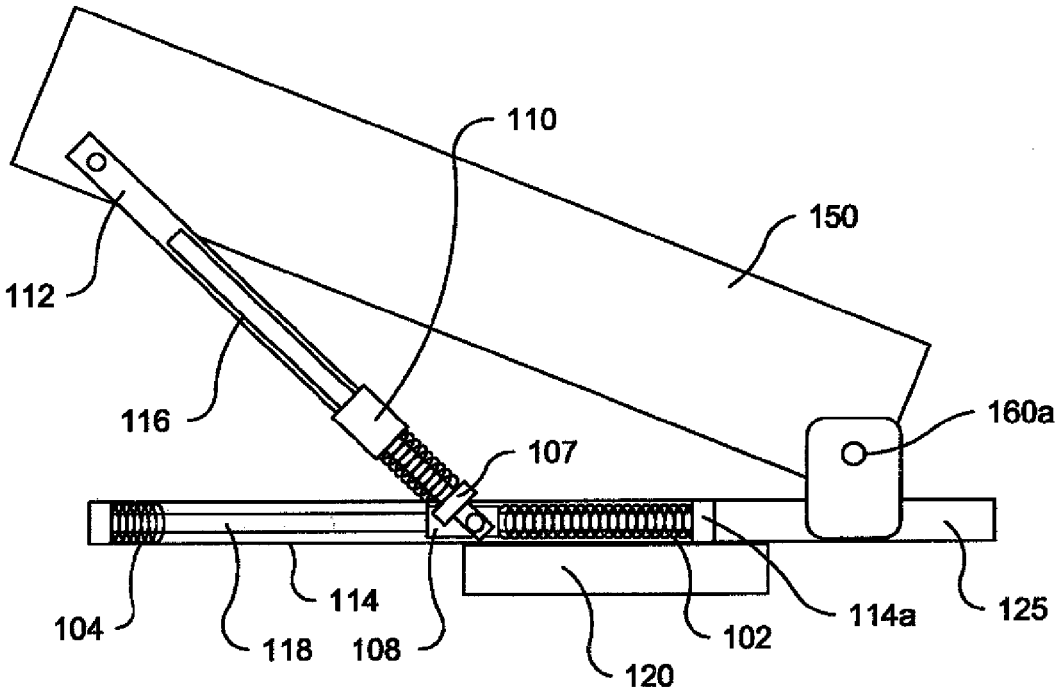
FIG. 7 illustrates the radar array antenna of FIG. 5 wherein the first linear induction driver provides secondary lowering force to the radar array antenna.
Figure 8:
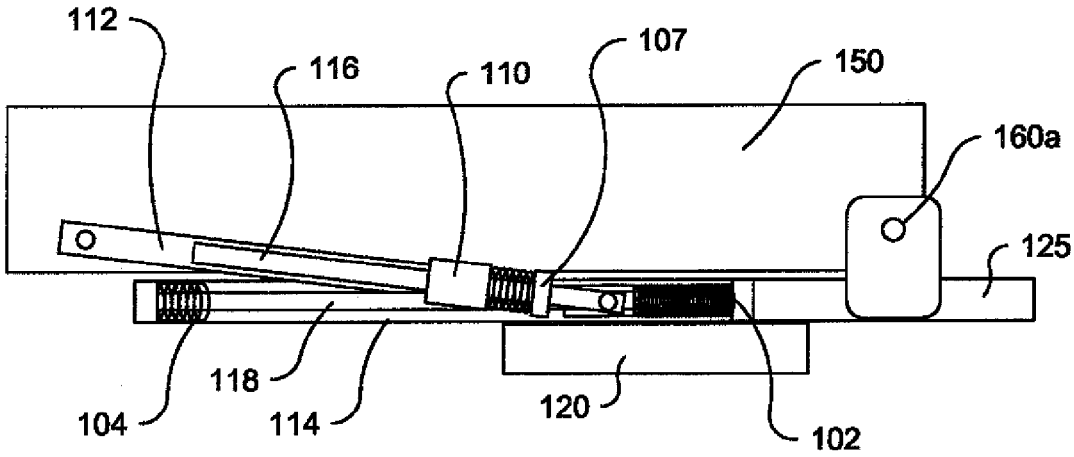
FIG. 8 illustrates the radar array antenna of FIG. 5 wherein the first spring element provides a braking force when stowing the radar array antenna.

Referring now to FIGS. 7 and 8, controller 180 (of FIG. 1) causes the supply of electric power to driver 108 which then starts moving along 118 towards end 114*a*. Second member 116 pivots about driver 108 and causes antenna 150 to be further lowered. When driver 108 reaches the first pre-determined position along first member 118, encoder 170 (of FIG. 1) causes transmission of a signal to controller 180 (of FIG. 1). Controller 180 (of FIG. 1), responsive to signal from encoder 170 (of FIG. 1), reduces and/or interrupts electric power supply to driver 108. Spring element 102 provides a braking force as it gets compressed upon engaging with driver 108 as driver 108 continues moving towards end 114*a*. Antenna 150 is now in a stowed position.

Figure 11:
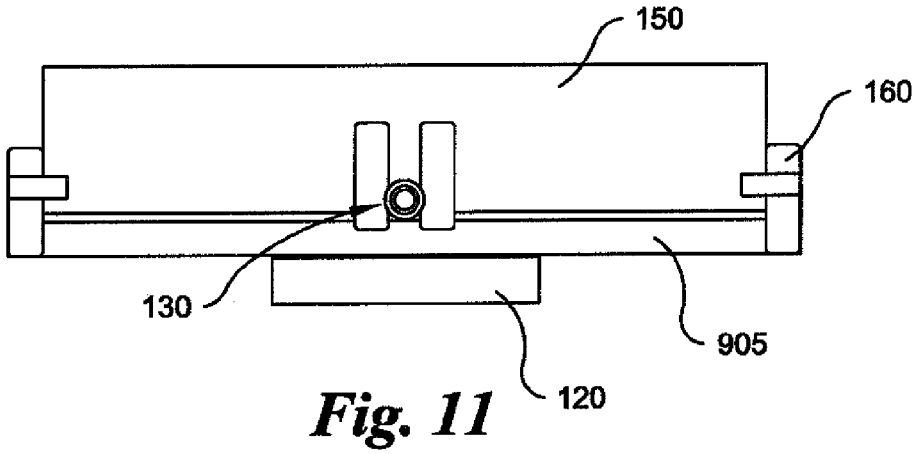
FIG. 11 illustrates a side view of an embodiment of a dual balanced lift actuator for a radar array antenna in a stowed position.
Figure 12:
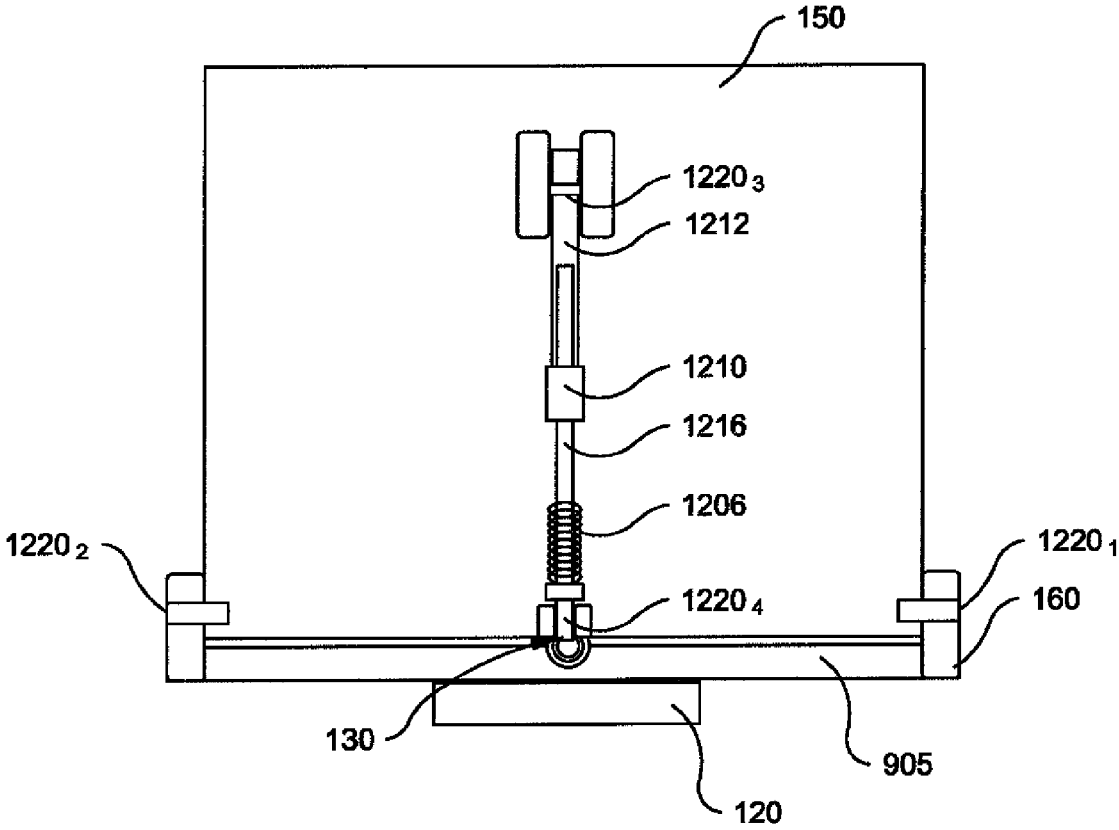
FIG. 12 illustrates a side view of the embodiment of FIG. 11 in a deployed position.

FIGS. 11 and 12 illustrate end views of another embodiment of the lift actuator mechanism 130, along with antenna 150, in a stowed and a deployed position respectively. In the illustrated embodiment, lift mechanism 130 includes a single second member 1216 coupled with a second driver 1210, third member 1212, and a spring element 1206. Antenna 150 is connected to pivoting members 160 via two pins $\mathbf{1220}_1$, $\mathbf{1220}_2$. The single lift actuator is positioned substantially central to antenna frame 905 and operates in conjunction with the controller mechanism as described herein to support, raise and lower array 150 in a stable and uniform manner with pivot pins $\mathbf{1250}_3$ and $\mathbf{250}_4$.

Figure 13:
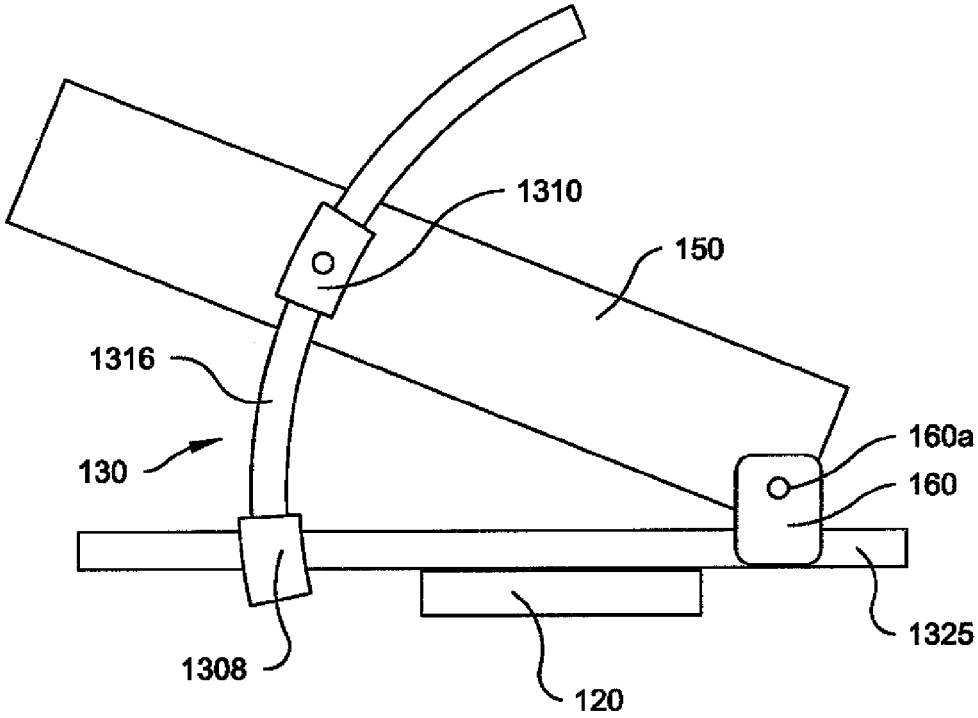
FIG. 13 illustrates yet another embodiment of a lift actuator for a radar array antenna.

Referring now to FIG. 13, there is illustrated another embodiment of the lift mechanism 130, along with antenna 150. Lift actuator mechanism 130 includes a pair of curvilinear parallel tracks 1316, each of tracks 1316 positioned on opposite ends of antenna frame 905. The side view of FIG. 13 shows one of curvilinear tracks 1316. Curvilinear track or member 1316 and two forcers 1308, 1310. Forcer 1308 may be fixed to a base 1325. Forcer 1310 is fixed to antenna 150 and is movably coupled to member 1316. Forcer 1310 is movable along member 1316 such that the movement of driver 1316 causes the movement of antenna 150. Since antenna 150 is constrained to pivot about pivoting member 160, movement of driver 1316 may cause antenna 150 to either move up to an operational position or to move down to a stowed position. Forcers 1308, 1310 may be operated either serially or independently so long as there is no physical interference between forcers 1308, 1310. In similar fashion to aforementioned embodiments of the present invention, one or more exemplary spring elements may be positioned for providing lift. For example, one or more asymmetric, axially curvilinear springs may be disposed conformal to the curvilinear track to supply enhanced reduction in lift force requirement. Alternatively or additionally, one or more torsion springs may be mounted coaxially with the pins about which the antenna array pivots when being raised and/or lowered.

It will be apparent to those skilled in the art that modifications and variations may be made in the apparatus and process of the present invention without departing from the spirit or scope of the invention. It is intended that the present invention cover the modification and variations of this invention provided they come within the scope of the appended claims and their equivalents.

What is claimed is:

1. A lift actuator for supporting a radar antenna array and for selectively moving the antenna array between a retracted position and an erected operational position, said actuator comprising:

a first linear induction driver movable along a first member, said first member having distal and proximal ends;

a second linear induction driver movable along a second member, said second member having distal and proximal ends, wherein said second member is pivotably connected to said first driver; and a third rigid member connected to said second driver, said third member having a distal end adapted to pivotably connect to a radar antenna array, wherein movement of said radar antenna array is constrained to pivoting about an axis at a proximal end and responsive to movement of said linear induction driver along said first member.

2. The lift actuator of claim 1, wherein said third member is at least partially hollow to accommodate said second member.

3. The lift actuator of claim 1, further comprising:

a first spring element disposed at said proximal end of said first member; and a second spring element disposed at said proximal end of said second member.

4. The lift actuator of claim 3, further comprising a third spring element disposed at said distal end of said first member.

5. The lift actuator of claim 1, further comprising a rotatable platform, said platform supporting the lift actuator.

6. The lift actuator of claim 1, further comprising:

a first means for detecting the position of said first driver relative to said first member; and a second means for detecting the position of said second driver relative to said second member.

7. The lift actuator of claim 1, further comprising:

a third linear induction driver movable along a fourth member, said fourth member having distal and proximal ends;

a fourth linear induction driver movable along a fifth member, said fifth member having distal and proximal ends, wherein said fifth member is pivotably connected at said proximal end to said third driver; and a sixth member connected to said fourth driver, said sixth member having a distal end adapted to pivotably connect to the radar antenna array, wherein said sixth member is a rigid member.

8. The lift actuator of claim 1, further comprising:

a third linear induction driver movable along a fourth member, said fourth member having distal and proximal ends;

a fourth linear induction driver movable along a fifth member, said fifth member having distal and proximal ends, wherein said fifth member is pivotably connected to said third driver; and a sixth rigid member connected to said fourth driver, said sixth member having a distal end adapted to pivotably connect to the radar antenna array.

9. The lift actuator mechanism of claim 1, further comprising a locking mechanism adapted to fix the position of said second driver along said second member when the radar antenna is in an operational position.

10. A system for supporting a radar antenna array and for selectively moving the antenna between a retracted position and an erected operational position, said actuator comprising:

a radar array antenna;

a lift actuator comprising:

a first linear induction driver movable along a first member, said first member having distal and proximal ends;

a second linear induction driver movable along a second member, said second member having distal and proximal ends, wherein said second member is pivotably connected at said proximal end to said first driver; and a third member connected at a distal end thereof to said second driver, and pivotably connected at a proximal end thereof to a proximal end of said radar antenna array, wherein said third member is a rigid member; and a pivoting member pivotably coupled to a distal end of the array antenna so as to constrain the array motion to pivoting about an axis and responsive to movement of said linear induction driver along said first member.

11. The system of claim 10, further comprising:

a first spring element disposed at said proximal end of said first member; and a second spring element disposed at said proximal end of said second member.

12. The system of claim 10, further comprising a third spring element disposed at said distal end of said first member.

13. The system of claim 10, further comprising a rotatable platform, said platform supporting said lift actuator.

14. The system of claim 10, further comprising:

a third linear induction driver movable along a fourth member, said fourth member having distal and proximal ends;

a fourth linear induction driver movable along a fifth member, said fifth member having distal and proximal ends, wherein said fifth member is pivotably connected at said proximal end to said third driver; and a sixth member connected to said fourth driver, said sixth member having a distal end adapted to pivotably connect to the radar antenna array, wherein said sixth member is a rigid member.

15. The system of claim 10, further comprising:

a first locking mechanism adapted to fix the position of said second driver along said second member when the radar antenna is in an operational position; and a second locking mechanism adapted to fix the position of said fourth driver along said fifth member when the radar antenna is in an operational position.

16. A system comprising:

a radar array antenna wherein said antenna is pivotably constrained at a first end;

a first linear driver motor with a first spring element;

a second linear driver motor with a second spring element;

wherein, in response to an activating event, said first spring element in a compressed state, expands to urge said first linear driver motor along a first axis with only mechanical energy to a first position, wherein, in response to the activating event, said second spring element in a compressed state, expands to urge said second linear driver motor along a second axis with only mechanical energy to a second position, wherein, said first and second linear driver motors are energized by electric power, upon passing said first and second positions respectively, to move said antenna to an operational position.

17. A system for supporting a radar antenna array and for selectively moving the antenna array between a retracted position and an erected operational position, said actuator comprising:

a frame mounted on a platform;

a first linear induction driver fixed to said frame;

a pivoting member connected to said frame;

a curvilinear member movably coupled to said first driver; and a second linear induction driver fixed to the radar antenna array, said second driver movably coupled to said curvilinear member and movable along said curvilinear member such that movement of said second driver causes the movement of the antenna array, wherein said radar antenna array is constrained to pivoting about said pivoting member.

* * * * *